US010359058B2

(12) United States Patent
Schuette et al.

(10) Patent No.: US 10,359,058 B2
(45) Date of Patent: Jul. 23, 2019

(54) HYDRAULIC DRIVE DEVICE WITH LOAD-DEPENDENT PRESSURE DISTRIBUTOR

(71) Applicant: Robert Bosch GmbH, Stuttgart (DE)

(72) Inventors: Michael Schuette, Langenau (DE); Peter Loewe, Burgrieden (DE)

(73) Assignee: Robert Bosch GmbH, Stuttgart (DE)

( * ) Notice: Subject to any disclaimer, the term of this patent is extended or adjusted under 35 U.S.C. 154(b) by 104 days.

(21) Appl. No.: 15/426,515

(22) Filed: Feb. 7, 2017

(65) Prior Publication Data

US 2017/0227025 A1 Aug. 10, 2017

(30) Foreign Application Priority Data

Feb. 10, 2016 (DE) ..... 10 2016 201 971

(51) Int. Cl.
*F15B 11/04* (2006.01)
*B66D 1/44* (2006.01)
*F15B 11/044* (2006.01)

(52) U.S. Cl.
CPC ..... *F15B 11/044* (2013.01); *B66D 1/44* (2013.01); *F15B 11/0445* (2013.01);
(Continued)

(58) Field of Classification Search
CPC ... F15B 11/042; F15B 11/044; F15B 11/0445; F15B 2211/30505; F15B 2211/30565;
(Continued)

(56) References Cited

U.S. PATENT DOCUMENTS 9,091,369 B2 * 7/2015 Froehlich ..... F15B 1/022
9,782,800 B2 * 10/2017 Renz ..... B06B 1/186
(Continued)

FOREIGN PATENT DOCUMENTS

DE 10 2008 010 270 A1 8/2009
DE 10 2010 055 718 A1 6/2012
(Continued)

OTHER PUBLICATIONS

German Search Report corresponding to German Application No. 10 2016 201 971.6, dated Oct. 4, 2016 (9 pages).

*Primary Examiner* — Michael E Gallion
(74) *Attorney, Agent, or Firm* — Maginot, Moore & Beck LLP

(57) ABSTRACT

A hydraulic drive device includes a pump, a hydraulic machine, and a tank. The hydraulic machine is connected fluidically to first and second fluid lines, which are configured to be connected fluidically to the tank or the pump via an adjustable main valve. The device further includes a first valve with a continuously adjustable first orifice. Pressure fluid is configured to be conducted out of the second fluid line via the first orifice and into the tank. The first valve is acted upon in the closing direction of the first orifice by a first spring and acted upon in the opposite direction by the pressure at a control point. The control point is connected fluidically to the tank via a first throttle device, connected via a second throttle device to the first fluid line, and connected to the first fluid line via a third throttle device and a second valve.

11 Claims, 3 Drawing Sheets

(52) U.S. Cl.
CPC ..... *F15B 2211/30505* (2013.01); *F15B 2211/30565* (2013.01); *F15B 2211/365* (2013.01); *F15B 2211/50581* (2013.01); *F15B 2211/5159* (2013.01); *F15B 2211/528* (2013.01); *F15B 2211/6355* (2013.01); *F15B 2211/7058* (2013.01)

(58) Field of Classification Search
CPC ..... F15B 2211/365; F15B 2211/50581; F15B 2211/5159; F15B 2211/528; F15B 2211/6355; F15B 2211/7058; B66D 1/44
See application file for complete search history.

(56) References Cited

U.S. PATENT DOCUMENTS

| | | | | |
|---|---|---|---|---|
| 2008/0250781 | A1* | 10/2008 | Mueller | B60K 6/12 60/414 |
| 2012/0285159 | A1* | 11/2012 | Sugano | B66D 1/44 60/470 |
| 2015/0135697 | A1* | 5/2015 | Shimizu | E02F 9/2235 60/425 |
| 2015/0369262 | A1* | 12/2015 | Kubo | F15B 11/044 137/565.01 |

FOREIGN PATENT DOCUMENTS

| | | | |
|---|---|---|---|
| DE | 10 2012 207 880 | A1 | 11/2012 |
| EP | 2 667 038 | A2 | 11/2013 |

* cited by examiner

HYDRAULIC DRIVE DEVICE WITH LOAD-DEPENDENT PRESSURE DISTRIBUTOR

This application claims priority under 35 U.S.C. § 119 to patent application no. DE 10 2016 201 971.6, filed on Feb. 10, 2016 in Germany, the disclosure of which is incorporated herein by reference in its entirety.

BACKGROUND

The disclosure relates to a hydraulic drive device.

DE 10 2010 055 718 A1 discloses a hydraulic drive device which is provided for use with a cable winch. Particular precautions were taken to prevent an uncontrolled lowering of the load on the cable winch. Reference should be made in this regard to the brake valve there which corresponds to the first valve of the present application.

One advantage of the present disclosure lies in the fact that the energy consumption of the hydraulic drive device is low, in particular if light loads are supposed to be lowered with the cable winch. Moreover, a steady, vibration-free lowering of the load is enabled independently of the load to be lowered.

SUMMARY

According to the disclosure, this object is achieved in that the control point is connected to the first fluid line via a third throttle device and a second valve. The first, the second and the third throttle device form a pressure distributor, the output pressure of which bears against the control point, wherein the pressure distribution ratio of this pressure distributor is adjustable by means of the second valve. The second valve is preferably adjustable in a manner dependent on the pressure in the second fluid line. This pressure is in turn dependent on the load on the hydraulic machine. The third throttle device can preferably be optionally activated or deactivated by means of the second valve.

In the case of low pressure in the second fluid line, the second and the third throttle device jointly preferably bring about a low degree of vibration damping. This case is present when lowering small loads on the cable winch. In the case of high pressures in the second fluid line, the third throttle device is preferably deactivated with the second valve, as a result of which the damping action increases. This case is present when lowering large loads on the cable winch. As a result, in the case of large loads, the necessary high damping action is produced without the pressure in the first fluid line rising excessively in the case of small loads. The energy consumption is reduced as a result.

Advantageous further developments and improvements of the disclosure are indicated in the dependent claims.

It can be provided that the second valve has an adjustable second orifice, wherein it is acted upon by the pressure in the second fluid line in the closing direction of the second orifice. The pressure in the second fluid line is dependent on the load on the hydraulic machine. As a result of the proposed measure, the third throttle device is deactivated in the case of high loads. It will be obvious that the second valve can also be actuated in a different manner as a function of load, for example, by means of an electromagnet which is activated by an electronic control device which in turn measures the pressure in the second fluid line by means of a pressure sensor. This is, however, complex and expensive.

It can be provided that the second valve is acted upon by a second spring in the opening direction of the second orifice. With the second spring, the second valve is opened in the case of low loads on the hydraulic machine such that the third throttle device become active.

It can be provided that the third throttle device and the second valve are connected in series. The second orifice and the third throttle device are preferably connected in series. As a result of this, the third throttle device can be activated and deactivated in a particularly simple manner by adjusting the second orifice.

It can be provided that the first valve is acted upon in the closing direction of the first orifice exclusively by the first spring. The corresponding valve side towards the tank is preferably relieved of pressure. The pressure actuation provided in DE 10 2010 055 718 A1 from the second fluid line is thus not present. This would impair the function according to the disclosure of the third throttle device.

It can be provided that the flow resistance of the second and/or the third throttle device is dependent on the direction with which the pressure fluid flows through the relevant throttle device. As a result of this, system vibrations can be avoided. Moreover, uncontrolled lowering of the load on the cable winch can furthermore be reliably avoided.

It can be provided that the flow resistance of the second and/or the third throttle device from the first fluid line towards the control point is smaller than the flow resistance in the opposite direction. The first valve thus only opens slowly so that system vibrations are avoided. It closes quickly so that uncontrolled lowering of the load is avoided.

It can be provided that the second and/or the third throttle device in each case comprise two throttle check valves which are connected in series in the opposite direction. As a result of this, a flow resistance, which is dependent on the flow direction, of the second or third throttle device can be realized in a simple manner. It can be provided that the first throttle device has a fixed flow resistance. It is in particular not necessary that the corresponding flow resistance is dependent on the throughflow direction of the first throttle device since flow always occurs through it in the same direction. This is different in the case of the second and third throttle device since the throughflow direction there is dependent on whether the pressure in the first fluid line or the pressure at the control point is higher.

It can be provided that there is arranged in the second fluid line a first check valve which exclusively allows a fluid flow from the main valve to the hydraulic machine, wherein the first valve is connected between the first check valve and the hydraulic machine to the second fluid line. During lowering of the load, no pressure fluid can thus flow via the main valve into the tank, rather only via the first valve. Full opening of the main valve does not lead to uncontrolled lowering of the load. It will be obvious that this function can also be achieved by a correspondingly designed main valve. A main valve which is available from catalogues and is thus low-cost should, however, be used in the present case.

It can be provided that the hydraulic machine is connected in terms of rotational drive to a cable winch. This is the preferred application of the drive device according to the disclosure, wherein other applications are also conceivable.

It will be obvious that the above-mentioned features and the features still to be explained below can not only be used in the combination indicated in each case, but also in other combinations or on their own, without departing from the scope of the present disclosure.

BRIEF DESCRIPTION OF THE DRAWINGS

The present disclosure is explained in greater detail on the basis of the enclosed drawings. In the drawings.

DETAILED DESCRIPTION

Figure 1:
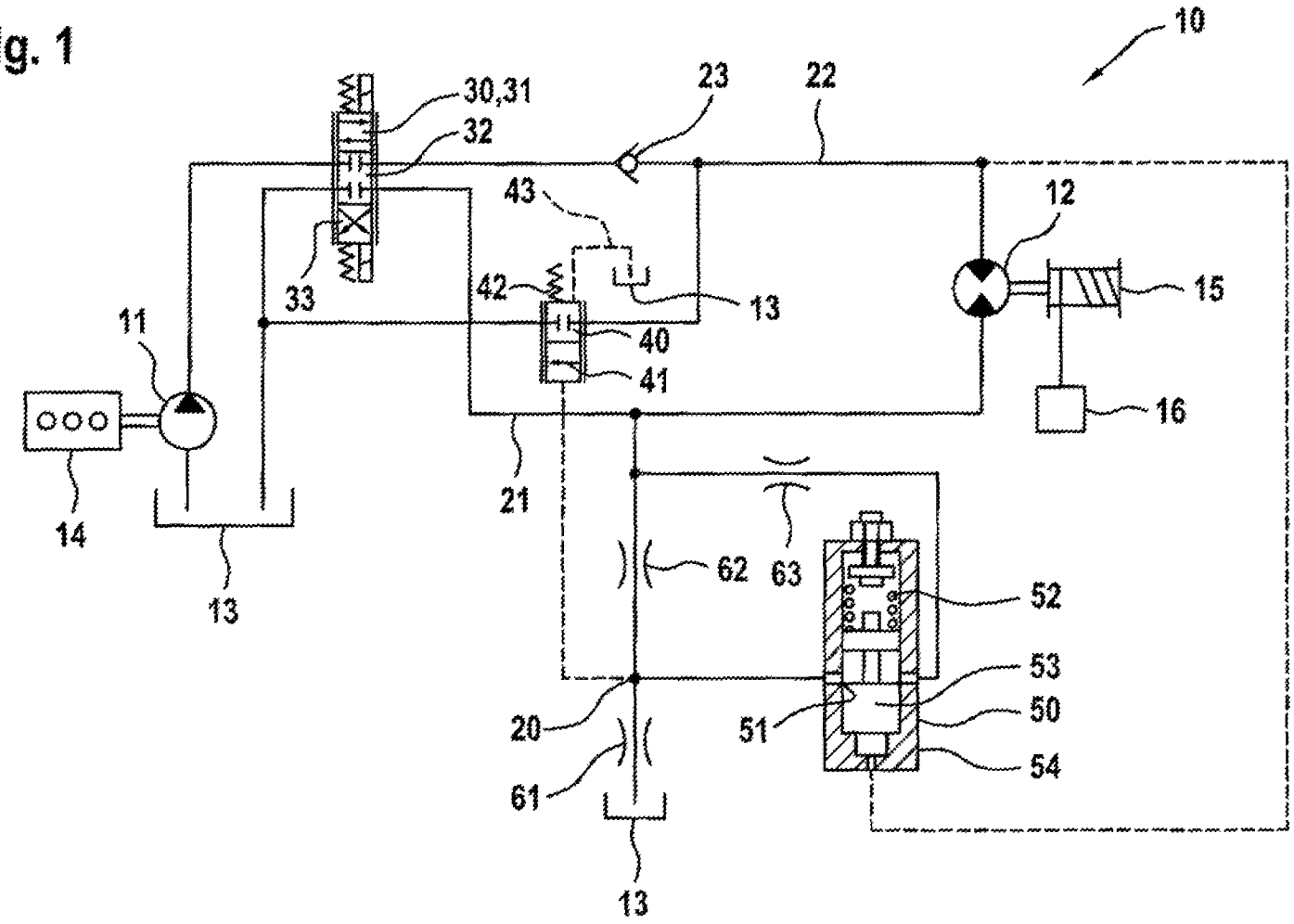
FIG. 1 shows a circuit diagram of a first embodiment of a hydraulic drive device according to the disclosure.

FIG. 1 shows a circuit diagram of a first embodiment of a hydraulic drive device 10 according to the disclosure. Drive device 10 is in particular provided for use with a cable winch 15 with which a load 16 can be raised and lowered. Cable winch 15 is connected in terms of rotational drive to a hydraulic machine 12 which can be embodied, for example, as an axial piston machine with an oblique axis design, wherein it can have a constant or an adjustable displacement volume. Hydraulic machine 12 operates as a hydraulic motor when raising load 16, wherein it operates as a pump when lowering load 16.

Hydraulic machine 12 is connected fluidically to a first and a second fluid line 21; 22. When raising load 16, pressure fluid is conveyed by pump 11 via second fluid line 22 to hydraulic machine 12, wherein it flows via first fluid line 21 back to tank 13. When lowering load 16, pump 11 conveys the pressure fluid via first fluid line 21 to hydraulic machine 12, wherein it flows via second fluid line 22 back to tank 13. The corresponding fluid connections are produced with main valve 30 which is formed in the present case as a proportional directional control valve with three positions. In central second position 32, all fluid connections are shut off so that hydraulic machine 12 is deactivated, wherein it is hydraulically clamped so that it also does not move under load. Load 16 is raised in first position 31. Load 16 is lowered in third position 33. Main valve 30 is preferably pretensioned by means of springs into second position 32. It can be moved, for example, by means of electromagnets, electrohydraulically or by hand into other positions 31; 33.

Pump 11 sucks pressure fluid out of tank 13 and conveys it under pressure to main valve 30. The pressure fluid is preferably a fluid and most preferably hydraulic oil. Pump 11 is embodied, for example, as an axial piston pump which preferably has an adjustable displacement volume. It is preferably connected in terms of rotational drive to a drive motor 14 which is embodied, for example, as an internal combustion engine, in particular as a diesel engine.

When lowering load 16, the situation could arise that it accelerates in an uncontrolled manner, wherein pump 11 does not convey enough pressure fluid in order to fully fill first fluid line 21 with pressure fluid. Damaging cavitation is generated as a result. In order to counter this problem, a first check valve 23 is provided in second fluid line 22, which first check valve 23 exclusively allows a fluid flow from main valve 30 to hydraulic machine 12. The pressure fluid can thus not flow back via main valve 30 to tank 13 when lowering load 16. An uncontrolled lowering of load 16 correspondingly then also does not arise when the corresponding orifice in main valve 30 is fully opened. As an alternative to first check valve 23, the corresponding flow path to tank 13 in main valve 30 in its third position 33 could be closed off.

First valve 40 is connected to second fluid line 22 between first check valve 23 and hydraulic machine 12. First valve 40 has a continuously adjustable first orifice 41 via which pressure fluid can flow from second fluid line 22 into tank 13 and indeed avoiding main valve 30. First valve 40 is pushed by a first spring 42 into the closed position, wherein the corresponding valve side towards tank 13 is depressurized 43. In the opening direction of first orifice 41, first valve 40 is acted upon by the pressure at a control point 20. The pressure at control point 20 is dependent on the pressure in first fluid line 21. First spring 42 is preferably configured so that an adjustment of first orifice 41 which is substantially proportional to the pressure at control point 20 is produced over a predetermined pressure range.

When raising load 16, i.e. in first position 31 of main valve 30, first fluid line 21 is connected to the tank so that the pressure there is low. As a result, the pressure at control point 20 does not exceed the pressure equivalent of first spring 42 so that first orifice 41 is closed off. First valve 40 correspondingly has no effects on the function of drive device 10 when raising load 16.

When lowering load 16, first fluid line 21 is connected to pump 11. First valve 40 only opens when the pressure at control point 20 exceeds the pressure equivalent of first spring 42. Pressure fluid can thus only flow back to tank 13 if the pressure in first fluid line 21 is sufficiently high. As a result, no cavitation can arise and an uncontrolled lowering of load 16 is ruled out. The pressure in first fluid line 21 is set to a value which depends on the pressure equivalent of first spring 42. The pressure in first fluid line 21 is preferably selected to be so high that vibrations on cable winch 15 are avoided or so that load 16 is lowered steadily. For this purpose, in the case of heavy loads 16, a higher pressure is required than in the case of small loads 16. It will be obvious that this pressure brings about energy losses. These should be reduced by the present disclosure. The pressure in second fluid line 22 is set to be at least so high that it can carry the weight force of load 16 during lowering via hydraulic machine 12. It is furthermore increased by the pressure in first fluid line 21.

A first, a second and a third throttle device 61; 62; 63 are provided which form a hydraulic pressure distributor. The pressure fluid can flow from first fluid line 21 via second throttle device 62, further via above-mentioned control point 20 and further via first throttle device 61 to tank 13. The pressure at control point 20 is thus a fraction of the pressure in first fluid line 21 which is dependent on the flow resistance of first and second throttle device 61; 62. These are configured so that in the case of heavy loads 16 to be reduced optimum pressure conditions are produced in terms of energy losses and the tendency to vibrate.

Third throttle device 63 and second valve 50 are furthermore connected between first fluid line 21 and control point 20. If second valve 50 is opened, third throttle device 63 is connected parallel to second throttle device 62 so that their joint flow resistance is lower than the flow resistance of second throttle device 62 alone. In this state, a smaller pressure in first fluid line 21 is thus sufficient in order to raise the pressure at control point 20 so far that first valve 40 opens. If second valve 50 is closed, third throttle device 63 is not active.

Second valve 50 has an adjustable second orifice 51 which is connected in series with third throttle device 63. It does not matter here whether second orifice 51 is connected upstream or downstream of third throttle device 63. Second orifice 51 is delimited, for example, by a movable valve slide 53 and by housing 54 of second valve 50. Second valve 50, in particular valve slide 53 thereof, is acted upon by a second spring 52 in the opening direction of second orifice 51. In the closing direction, it is acted upon by the pressure in second fluid line 22. This is, as mentioned above, primarily dependent on the weight of load 16 to be lowered. Second valve 50 is correspondingly opened in the case of small loads 16, wherein it is closed in the case of heavy loads 16. By suitable configuration of the flow resistance of third throttle device 63, those pressure conditions which are optimum in the case of small loads 16 in terms of energy losses and the tendency to vibrate can therefore be set.

In the case of the first embodiment of the disclosure, first, second and third throttle device 61; 62; 63 are formed as orifices with a flow resistance which is constant during operation. This can be fixedly defined or adjustable. Adjustment of the flow resistance preferably only takes place once when commissioning the drive device.

Figure 2:
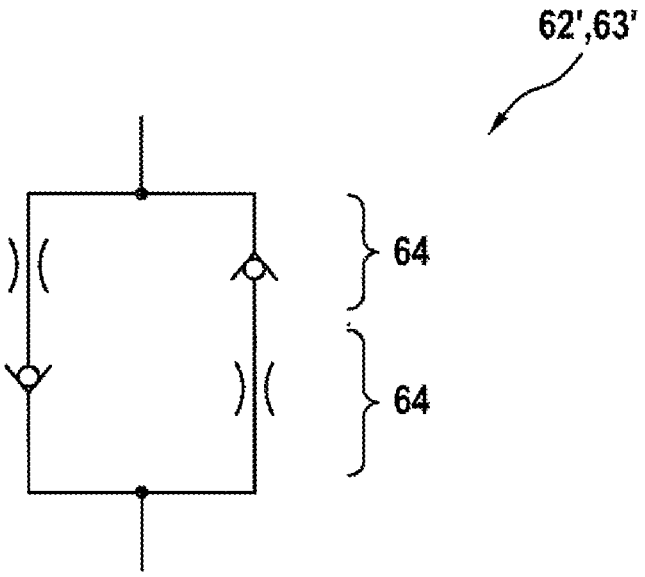
FIG. 2 shows a circuit diagram of the second or third throttle device of a second embodiment of the disclosure.

FIG. 2 shows a circuit diagram of second or third throttle device 62'; 63' of a second embodiment of the disclosure. These are formed in each case to be structurally identical, wherein only the flow resistances of the orifices used differ. The flow resistance of second and/or third throttle device 62'; 63' is dependent on the direction with which the pressure fluid flows through relevant throttle device 62'; 63'. In particular, the flow resistance from the first fluid line to the control point is smaller than the flow resistance in the opposite direction. As a result of this, the first valve only opens slowly when the pressure in the first fluid line rises above the pressure at the control point. System vibrations are avoided as a result. In contrast, the first valve closes quickly if the pressure in the first fluid line drops below the pressure at the control point. As a result, uncontrolled lowering of the load is avoided. Second and/or third throttle device 62'; 63' comprise in each case two throttle check valves 64 which are connected in series in the opposite direction.

The second embodiment is otherwise identical to the first embodiment, wherein reference is made in this regard to the designs in relation to FIG. 1.

Figure 3:
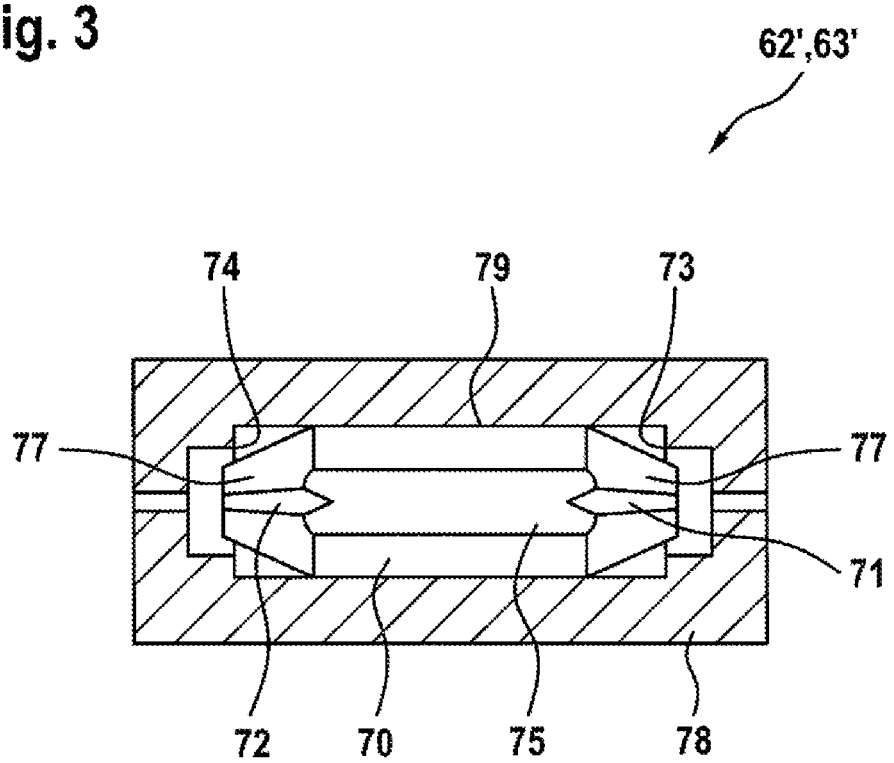
FIG. 3 shows a highly schematic longitudinal section of the second or third throttle device according to FIG. 2.

FIG. 3 shows a highly schematic longitudinal section of second or third throttle device 62'; 63' according to FIG. 2. Second or third throttle device 62'; 63' comprises a throttle pin 70 which is formed to be circular-cylindrical 79 in the center, wherein it is formed to be circular-conical 77 at the two opposite ends. Circular-cylindrical section 79 is received in an adapted bore so that throttle pin 70 is linearly movable. The cited bore is formed to be longer than throttle pin 70, wherein there is arranged at its opposite ends a first or a second valve seat 73; 74 which is closed by conical sections 79 in the manner of a conical seat valve. In each case a first or a second notch 71; 72 is provided on relevant conical section 77 in the region of first or second valve seat 73; 74. If throttle pin 70 is pushed by the pressure fluid flowing from the left in FIG. 3 against first valve seat 73, first notch 71 is active as an orifice. If throttle pin 70 is pushed by the pressure fluid flowing from the right in FIG. 3 against second valve seat 74, second notch 72 is active as an orifice. In both fluids, the pressure fluid can flow past throttle pin 70 at lateral flat portion 75.

Figure 4:
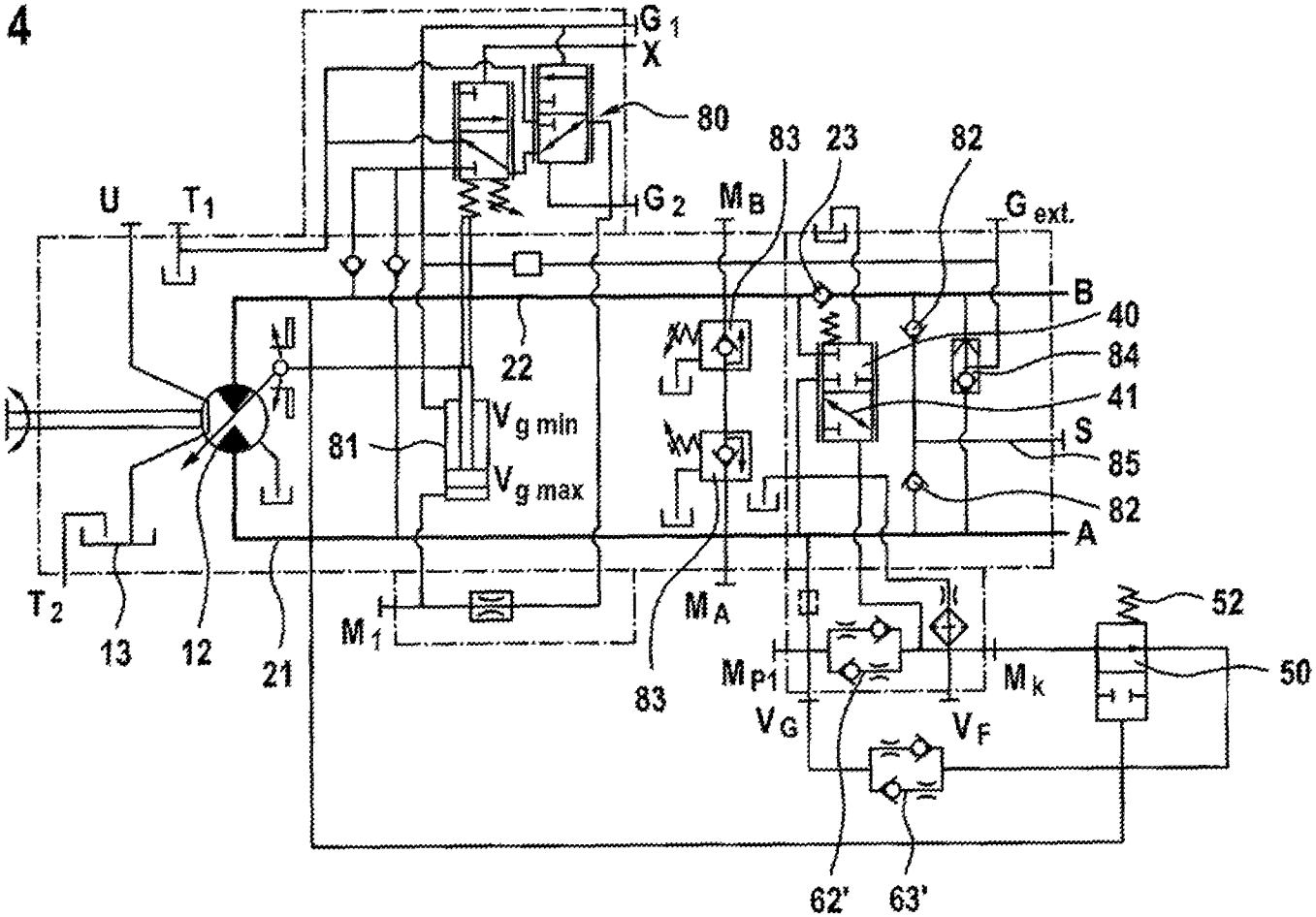
FIG. 4 shows a circuit diagram of a part of a third embodiment of the disclosure.

FIG. 4 shows a circuit diagram of a part of a third embodiment of the disclosure. The third embodiment is formed to be identical to the second embodiment apart from the differences described below, so that reference is made in this regard to the above statements in relation to FIGS. 1, 2 and 3. Identical or corresponding parts are characterized with the same reference numbers in FIGS. 1, 2 and 4.

First valve 40 is provided with an additional port which is connected fluidically to first fluid duct 21. This additional port does not have a function in the present case, it being intended for future further developments.

Hydraulic machine 12 has an adjustable displacement volume which can be adjusted with actuating cylinder 81. The actuating cylinder is connected to a known pressure controller 80.

First and second fluid line 21; 22 are connected in each case to a pressure limiting valve 83 in order to limit the upper pressures there. Pressure limiting valves 83 can be connected in the opposite direction between first and second fluid line 21; 22, as represented in the present case. They can, however, also be connected to tank 13. Pressure limiting valves 83 open, for example, when a heavy load 16 is stopped abruptly during movement. The inertial forces generated as a result can cause pressure peaks which are limited at the top by pressure limiting valves 83.

Shuttle valve 84 is connected on the input side to first and second fluid line 21; 22. The pressure on the output side of shuttle valve 84 can be used, for example, to actuate a retaining brake on the cable winch. This is closed when first and second fluid line 21; 22 are substantially depressurized, wherein they are opened when at least one of fluid lines 21; 22 conducts pressure.

Return line 85, via which first valve 40 is connected to the tank, is connected via two second check valves 82 to first and second fluid line 21; 22. Check valves 82 allow in each case only one fluid flow from return line 85 to first or second fluid line 21; 22. As a result of the build-up of the pressure fluid flowing back in return line 85 to tank 13, an increased pressure in comparison to the tank pressure can be set there. This is transmitted via second check valves 82 into assigned fluid line 21; 22 in so far as a low pressure prevails there. In this manner, cavitation can be avoided particularly reliably.

REFERENCE NUMBERS

10 Hydraulic drive device
11 Pump
12 Hydraulic machine
13 Tank
14 Drive motor
15 Cable winch
16 Load
20 Control point
21 First fluid line
22 Second fluid line
23 First check valve
30 Main valve
31 First position
32 Second position
33 Third position
40 First valve
41 First orifice
42 First spring
43 Depressurization
50 Second valve
51 Second orifice
52 Second spring
53 Valve slide
54 Housing
61 First throttle device
62 Second throttle device (first embodiment)
62' Second throttle device (second embodiment)
63 Third throttle device (first embodiment)
63' Third throttle device (second embodiment)
64 Throttle check valve
70 Throttle pin
71 First notch
72 Second notch

73 First valve seat
74 Second valve seat
75 Flat portion
77 Conical portion
78 Housing
79 Circular-cylindrical portion
80 Conveying pressure controller
81 Actuating cylinder
82 Second check valve
83 Pressure limiting valve
84 Shuttle valve
85 Return line

What is claimed is:

1. A hydraulic drive device, comprising:

a pump;

a tank;

a hydraulic machine directly connected fluidically to a first fluid line and a second fluid line;

an adjustable main valve configured optionally to fluidically connect the first and second fluid lines to the tank or the pump; and a first valve having a continuously adjustable first orifice, wherein pressure fluid is configured to be conducted out of the second fluid line via the first orifice into the tank, wherein the first valve is (i) acted upon in a closing direction of the first orifice by a first spring and (ii) acted upon in a direction opposite the closing direction by the pressure at a control point, and wherein the control point is (i) connected fluidically to the tank via a first throttle device and independent of the main valve, (ii) fluidically connected directly via a second throttle device to the first fluid line, and (iii) fluidically connected to the first fluid line via a third throttle device and a second valve.

2. The hydraulic drive device according to claim 1, wherein the second valve has an adjustable second orifice, the second valve acted upon by the pressure in the second fluid line in a closing direction of the second orifice.

3. The hydraulic drive device according to claim 2, wherein the second valve is acted upon by a second spring in an opening direction of the second orifice.

4. The hydraulic drive device according to claim 1, wherein the third throttle device and the second valve are connected in series.

5. The hydraulic drive device according claim 1, wherein the first valve is acted upon in the closing direction of the first orifice exclusively by the first spring.

6. The hydraulic drive device according to claim 1, wherein a flow resistance of one or more of the second throttle device and the third throttle device is dependent on the direction with which the pressure fluid flows through the respective throttle device.

7. The hydraulic drive device according to claim 6, wherein the flow resistance of the one or more of the second throttle device and the third throttle device from the first fluid line towards the control point is smaller than the flow resistance in the opposite direction.

8. The hydraulic drive device according to claim 6, wherein the one or more of the second throttle device and the third throttle device in each case comprise two throttle check valves that are connected in series in the opposite direction.

9. The hydraulic drive device according to claim 1, wherein the first throttle device has a fixed flow resistance.

10. The hydraulic drive device according to claim 1, wherein:

a first check valve is arranged in the second fluid line, the first check valve exclusively allowing a fluid flow from the main valve to the hydraulic machine, and the first valve is connected between the first check valve and the hydraulic machine to the second fluid line.

11. The hydraulic drive device according to claim 1, wherein the hydraulic machine is connected in terms of rotational drive to a cable winch.

* * * * *